United States Patent [19]

Galland et al.

[11] 4,391,172

[45] Jul. 5, 1983

[54] ROTARY CUTTING MACHINE

[75] Inventors: Lesley A. Galland; Bruce W. Skiver, both of Caldwell, Id.

[73] Assignee: J. R. Simplot Company, Boise, Id.

[21] Appl. No.: 246,926

[22] Filed: Mar. 24, 1981

[51] Int. Cl.[3] ..... B26D 3/28

[52] U.S. Cl. ..... 83/403; 83/411 R; 83/419; 83/733

[58] Field of Search ..... 83/403, 411 R, 733, 83/419

[56] References Cited

U.S. PATENT DOCUMENTS

| | | | |
|---|---|---|---|
| D. 201,770 | 7/1965 | Urschel . | |
| 302,993 | 8/1884 | Frost | 83/419 |
| 2,086,708 | 7/1937 | Ferry . | |
| 2,126,361 | 8/1938 | Urschel et al. . | |
| 2,187,957 | 1/1940 | Urschel | 83/403 |
| 2,195,879 | 4/1940 | Urschel et al. | 83/403 |
| 2,242,557 | 5/1941 | Urschel et al. . | |
| 2,436,410 | 2/1948 | Urschel et al. . | |
| 2,961,024 | 11/1960 | Urschel et al. . | |
| 3,053,296 | 9/1962 | Urschel et al. . | |
| 3,139,127 | 6/1964 | Urschel et al. . | |
| 3,139,128 | 6/1964 | Urschel et al. | 83/403 |
| 3,139,129 | 6/1964 | Urschel et al. | 83/403 |
| 3,139,130 | 6/1964 | Urschel et al. | 83/403 |
| 3,196,916 | 7/1965 | Urschel . | |
| 3,255,646 | 6/1966 | Urschel . | |
| 3,427,297 | 10/1969 | Urschel et al. | 83/403 |
| 3,435,864 | 4/1969 | Urschel et al. | 83/403 |
| 3,521,688 | 7/1970 | Urschel et al. | 83/403 |
| 3,823,880 | 7/1974 | Urschel | 83/403 |
| 3,857,310 | 12/1974 | Tiby . | |

*Primary Examiner*—James M. Meister

*Attorney, Agent, or Firm*—Fulwider, Patton, Rieber, Lee & Utecht

[57] ABSTRACT

A rotary cutting machine is provided for cutting vegetable products and the like, such as potatoes, into a plurality of smaller pieces, such as elongated shreds to form hashbrown potatoes. The cutting machine comprises a stationary cylindrical knife housing having about its periphery a plurality of axially extending open slots each lined on one side by a cutting knife. The product is supplied into an impeller mounted for rotation within the knife housing for centrifugally throwing the product into cutting engagement with the cutting knives. The impeller comprises a circular base plate closing one axial end thereof, an annular cover plate defining an enlarged central opening for admission of the product at the opposite axial end thereof, and at least one annular divider plate positioned axially between the base plate and the cover plate, all supported at their peripheries by a plurality of axially extending paddles. A central rotor projects from the base plate along the axis of the impeller and includes radially and axially extending vanes which, during operation, cooperate with the divider plate to divide the product for generally equal flow on opposite sides of the divider plate, and to orient the product with respect to the cutting knives.

30 Claims, 4 Drawing Figures

ROTARY CUTTING MACHINE

BACKGROUND OF THE INVENTION

This invention relates to a rotary cutting machine for cutting vegetable products and the like into a plurality of smaller pieces of desired size and shape. More particularly, this invention relates to an improve rotary cutting machine for slicing a vegetable product, such as a potato, into a plurality of elongated thin strips or shreds for use, for example, in the formation of hashbrawn potato patties or the like.

Rotary cutting or slicing machines in general are well known in the art, and typically comprise a radially open impeller mounted for rotation within a stationary outer housing. See, for example, U.S. Pat. No. 3,139,128. The product is fed axially into the interior of the impeller which throws the product by centrifugal force in a radially outward direction into engagement with a circumferentially arranged set of cutting knives carried by the outer housing. A plurality of paddles secured to the periphery of the impeller carry the product rotationally about the interior of the housing into sequential cutting engagement with the cutting knives for cutting the product into a plurality of smaller pieces.

Rotary cutting machines of this general type have been used to cut or slice a variety of vegetable products into smaller pieces having a variety of different sizes and shapes, depending upon the particular shape of the product fed to the machine and the particular configuration of the various cutting knives. For example, the machine can be adapted to slice whole potatoes into a plurality of slabs, French fry strips, or the like. Alternately, the machine can be adapted to cut potato pieces such as slabs or strips into other shapes such as elongated thin shreds to form hashbrown potatoes or the like.

For many vegetable products, it is desirable to orient the outer housing and the impeller with respect to a vertical axis, and to supply the product by gravity in a downward direction into the machine. With this arrangement, the impeller throws the product in a radially outward and generally horizontal direction toward the outer housing and the cutting knives, with at least some uniformity of product distribution about the circumference of the housing. However, when the product is relatively small in size, such as when potato slabs or slices are provided for cutting into thin shreds, it has been found that the product falls directly to the bottom of the impeller and is thrown radially outwardly into engagement primarily with only the lower portion of each cutting knife. This undesirably limits the maximum production rate of the machine and results in relatively rapid wear of the lowermost portions of the cutting knives, thereby requiring relatively frequent stoppage of production to change or sharpen the knives. Moreover, since the product is typically supplied to the impeller in surges, a relatively large drive motor is required for continuous and substantially constant speed impeller rotation without stalling or overloading of the motor.

An additional problem encountered with prior art rotary cutting machines is that the product tends to orient at random for cutting by the cutting knives along the various longer and shorter dimensions of the product. That is, the various ones of the product are cut generally at random along their length, width, or thickness, resulting in an uncontrolled size distribution among the cut product pieces. For some vegetable products having significantly variant dimensions, this lack of control over the final size distribution can be highly undesirable. For example, when potato slabs or slices are cut into smaller potato shreds to form hashbrown potatoes, it is important to minimize the distribution of shorter-length pieces to improve the overall appearance of the final product. Moreover, in potato products, the formation of a substantial proportion of shorter-length pieces results in the release of undesirable quantities of free starch which can detrimentally affect the taste and appearance of the final product.

The present invention overcomes the problems and disadvantages of the prior art by providing an improved rotary cutting machine including apparatus for dividing the product for generally uniform engagement along the length of each cutting knife, and further including means for orienting the product with respect to the cutting knives for substantially increasing the proportional distribution of longer-length product pieces.

SUMMARY OF THE INVENTION

In accordance with the invention, an improved rotary cutting machine is provided including a stationary outer housing supporting a plurality of axially extending cutting knives and an improved central impeller mounted for rotation within the housing for receiving the product and for centrifugally throwing the product into cutting engagement with the cutting knives. The central impeller includes means for dividing the mass flow of product for flow into engagement with the cutting knives generally uniformly along the axial length of each cutting knife, and for orienting the product with respect to the cutting knives to improve the overall size distribution of the final product pieces.

In accordance with a preferred embodiment of the invention, the knife housing is generally cylindrical is shape and includes the plurality of the cutting knives each adjacent one side of an axially extending slot. The central impeller is rotatably driven within the knife housing and comprises a circular base plate closing one axial end of the housing and an annular cover plate at the opposite axial end of the housing. At least one annular divider plate has an inner diameter less than the inner diameter of the cover plate, and is interposed in parallel between the cover plate and the base plate. A plurality of relatively short and generally radially extending paddles are connected axially between the peripheries of the three plates to provide a structurally rigid stack of axially spaced plates rotatable as an integral unit within the knife housing.

A rotor projects from the base plate along the axis of the impeller toward the cover plate. The rotor includes a plurality of radially and axially extending vanes positioned generally in axial alignment with the divider plate and sized to define an annular chamber between the vanes and the divider plate. When the product is fed through the open cover plate into the rotating central impeller, the rotor vanes function to halt axial movement of a portion of the product and to centrifugally throw that portion into the radially open passage between the cover plate and the divider plate. The remaining portion of the product falls through the annular chamber between the vanes and the divider plate to strike the base plate which centrifugally throws that portion into the radially open passage between the divider plate and the base plate. The paddles at the periphery of the impeller carry the centrifugally thrown product into cutting engagement with the cutting knives. By appropriate adjustment of the relative sizes of the vanes and the divider plate, the product mass flow is divided into approximately two equal portions for generally uniform cutting engagement along the axial lengths of the cutting knives. This arrangement permits a substantially increased machine production rate, and further, minimizes the effects of surges of the product into the impeller to prevent overloading of the impeller drive motor.

When the product is shaped to have significant variations in dimension, the number of divider plates and axial dimensions between the plates can be selected to provide orientation of at least a substantial portion of the product with respect to the cutting knives. For example, when the product comprises potato slabs or slices having a relatively large length and/or width and a relatively small thickness, the axial dimensions between the plates can be chosen to be generally equal to or slightly less than an average product length or width to prevent a substantial portion of the product from entering the radially open passages between the plates unless the major plane of the product is oriented to extend generally in the radial direction corresponding with the plane of the axial passage. With this arrangement, the thin slabs or slices are cut by the cutting knives along their length or width, and not through their thickness, resulting in the production of thin product strips having a significantly improved overall length distribution.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
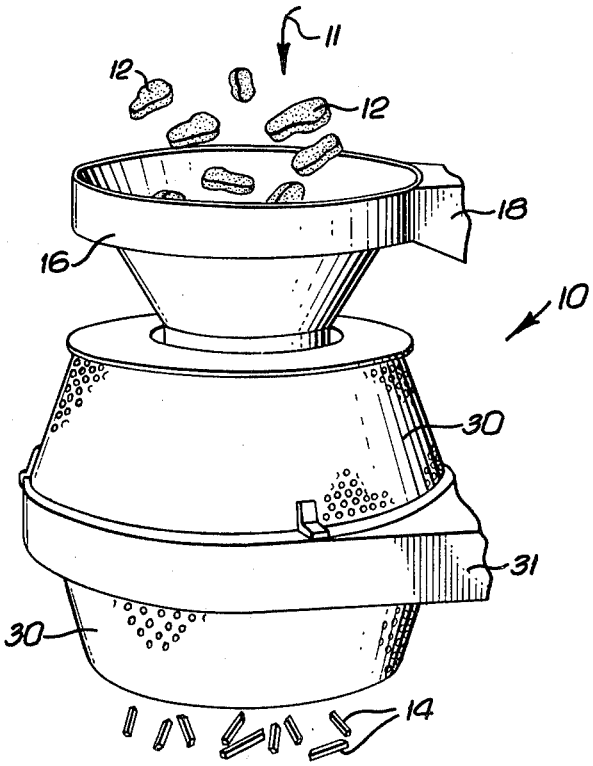
FIG. 1 is a fragmented perspective view illustrating in general a rotary cutting machine.

As illustrated in the exemplary drawings, the invention is embodied in a rotary cutting machine, indicated generally by the reference numeral 10, for dividing a vegetable product 12 or the like into a plurality of smaller pieces 14. For example, the product 12 can comprise a plurality of potato sections in the form of relatively thin slabs or slices which are cut by the machine 10 into a plurality of elongated and relatively thin strips or shreds to form so-called hashbrown potatoes. However, it is to be understood that the invention herein is applicable for use with a variety of other types and shapes of products, including whole potatoes and other vegetable or nonvegetable products for cutting the product into a variety of smaller pieces.

As in prior rotary cutting machines for similar purposes, the machine 10 includes a hopper 16 in the form of a downwardly converging funnel into which the product 12 is supplied, as illustrated in arrow 11, for feeding to cutting elements of the machine. The hopper 16 can be conveniently supported above the machine by a support arm 18 connected to suitable support structure (not shown). This hopper 16 defines a downwardly open passage 20 through which the product 12 falls into engagement with a central impeller 22. The impeller 22 is rotatably driven about a vertical central axis 23 to centrifugally throw the product 12 in a radially outward direction, as illustrated by arrows 13, for cutting engagement with a plurality of cutting knives 24 supported by a stationary housing 26, whereby the knives 24 sever the product 12 into the smaller pieces 14. These smaller pieces 14 are discharged from the housing 26 into an annular space 28 defined by an outer shroud 30 supported by another support arm 31 in a position about the knife housing to redirect the product pieces 14 downwardly toward appropriate further processing equipment (not shown). This general type of rotary cutting machine is described in more detail in U.S. Pat. No. 2,195,879.

Figure 2:
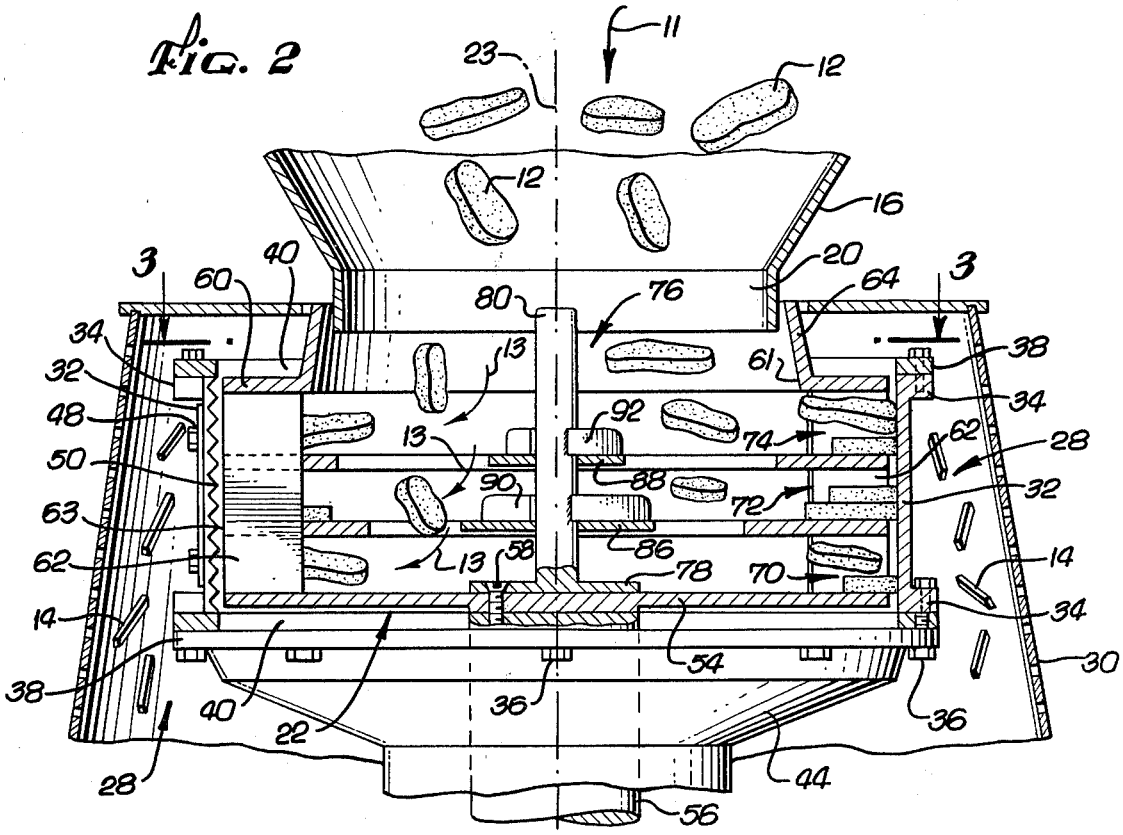
FIG. 2 is an enlarged fragmented vertical section of the machine illustrating the novel features of this invention.
Figure 3:
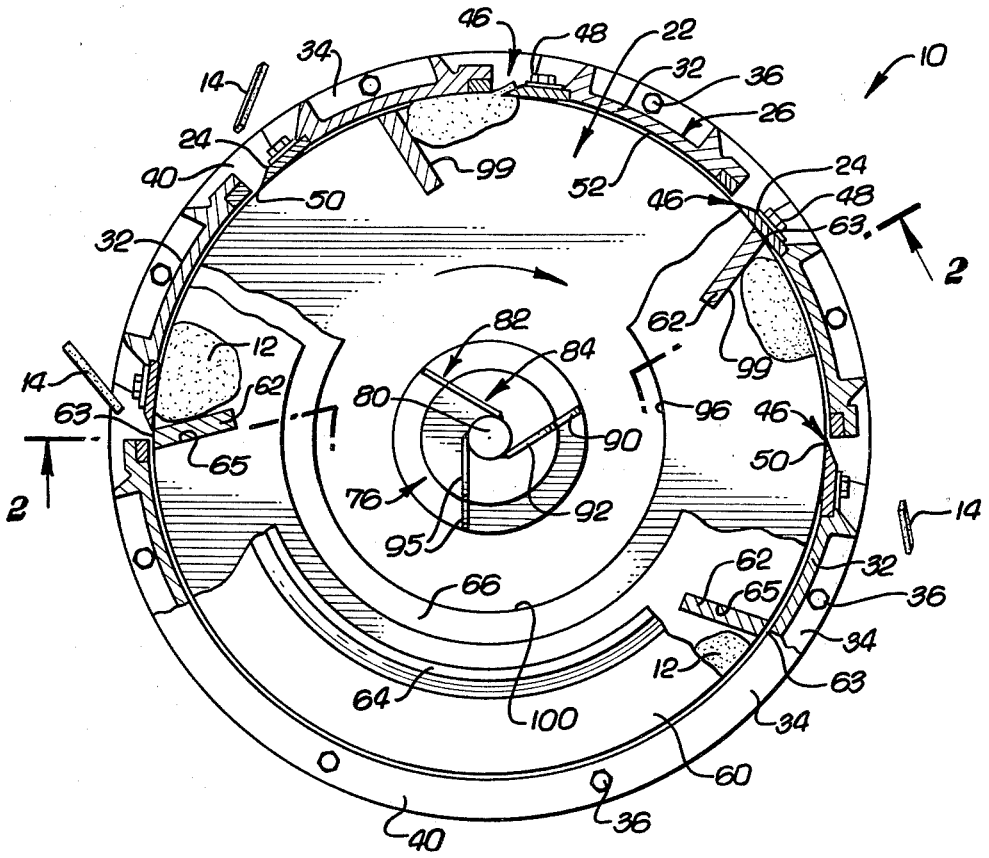
FIG. 3 is a horizontal section taken generally on the line 3—3 of FIG. 2, with portions broken away to illustrate construction details of the machine.

The knife housing 26 is shown in more detail in FIGS. 2 and 3. As shown, this knife housing 26 comprises a plurality of axially extending arcuate sections 32 including radially outwardly extending upper and lower flanges 34 for connection by bolts 36 to corresponding flanges 38 on a pair of upper and lower annular mounting rings 40. The lower mounting ring 40 is in turn secured by the bolts 38 to a lower support frame 44 which can be secured to appropriate support structure (not shown) to rigidly mount the knife housing 26 in a desired fixed position relative to the impeller 22, as will be described in more detail.

The arcuate sections 32 of the knife housing 26 are arranged about the annular mounting rings 40 in positions spaced circumferentially slightly from each other to define a plurality of slots 46 each of which extends in an axial direction parallel to the central axis 23 of the impeller 22. Each one of these slots 46 is lined on one axial side by one of the cutting knives 24 secured to the adjacent arcuate section 32 by mounting screws 48 or the like. The cutting knives each define an axially extending cutting edge 50 which, in the embodiment shown, has an alternating V-shaped pattern to divide the product into small shreds and is presented in a circumferential direction common to that of the remaining knives 24. Moreover, as shown in FIG. 3, the cutting edge 40 of each knive 24 is radially inset from the arcuate inner surface 52 of the arcuate sections 32 to position the knives 24 for cutting engagement with the product 12.

According to the invention, the impeller 22 is designed to divide the product 12 supplied into the machine 10 into a plurality of smaller mass flows which are axially separated from each other for engagement with the cutting edges 50 of the cutting knives 24 along substantially the entire axial lengths of these knives. This enables the cutting knives to be used for maximum production rates with maximum intervals between replacement or sharpening. Moreover, the impeller 22 is adapted for orienting at least a substantial portion of the product 12 before engagement with the cutting knives 24 to substantially increase the overall length distribution of the cut product pieces 14.

The impeller 22 is shown in detail in FIGS. 2 and 3 and comprises a generally cylindrical and radially open structure sized and shaped for relatively close reception within the knife housing 26. More specifically, the impeller 22 includes, at its lower axial end, a circular base plate 54 positioned with relatively small clearance within the lower end of the knife housing 26. This base plate 54 is secured to the upper end of a drive shaft 56 by means of a plurality of screws 58 or the like for rotation about the vertical axis 23. The drive shaft 56 in turn extends downwardly from the base plate 54 along the axis 23 and through the support frame 44 for connection to a suitable driving source (not shown), such as an electric motor.

The upper end of the impeller 22 is defined by an annular cover plate 60 received with relatively small clearance within the upper end of the knife housing 26 in axially spaced, parallel relation with the base plate 54. This cover plate includes an enlarged central opening 61 in alignment with the downwardly open passage 20 in the hopper 16 to allow free passage of the produce 12 downwardly into the interior of the impeller 22. Conveniently, as shown in FIG. 2, an annular sleeve 64 can be provided to project upwardly from the inner diameter of the cover plate 60 concentrically about the lower end of the hopper 16 to positively guide the falling product into the impeller.

The base plate 54 and the cover plate 60 are structurally interconnected for rotation as a single unit by a plurality of paddles 62 which extend axially between the two plates and are connected thereto in a suitable manner such as welding. These paddles 62 are circumferentially arranged about the peripheries of the base plate 54 and the cover plate 60, and each paddle 62 includes a radially outwardly presented outer edge 63 positioned for close clearance with the cutting knives 24 of the knife housing 26 for carrying the product 12 into cutting engagement with the knives, as will be described in more detail. From the outer edge 63, each paddle extends generally radially toward the central axis 23 for a distance equal to or slightly less than the radial width of the cover plate 60. Importantly, the paddles 62 do not extend radially inwardly beyond the inner diameter of the cover plate 60 so as not to interfere with the product falling into the impeller.

As illustrated in the preferred embodiment in FIGS. 2 and 3, a pair of axially spaced divider plates 66 and 68 are interposed between the base plate 54 and the cover plate 60. The divider plates 66 and 68 are configured in the shape of annular rings having outer diameters corresponding with the outer diameter of the base and cover plates 54 and 60, and radially outwardly extending slots 65 for reception of the paddles 62. The divider plates 66 and 68 are secured to the paddles 62 by welding or the like in positions parallel with each other and with the base plate 54 and cover plate 60 to define three axially separate and radially open passages 70, 72, and 74 of substantially uniform axial dimension.

A rotor 76 projects upwardly along the central axis 23 of the impeller 22 to assist in centrifugal throwing of the product in a radial direction into the radially open passages 70, 72, and 74. More specifically, this rotor 76 comprises a base ring 78 secured to the base plate 54 as by the screws 58, and a shaft 80 projects upwardly from the base ring 78 along the axis 23. This rotor shaft 80 supports along its length two sets of axially and radially extending vanes 82 and 84 which function, upon rotation of the impeller 22, to divide the incoming product 12 into three smaller mass flows for flow into the axially separate passages 70, 72, and 74. As shown, these sets of vanes 82 and 84 are respectively positioned generally in axial alignment with the two divider plates 66 and 68 and are spaced radially inwardly from the plates to allow axial passage of at least some of the product 12 past the vanes toward the base plate 54.

Figure 4:
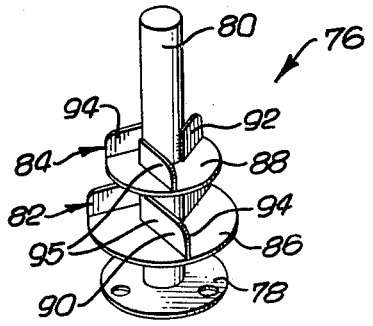
FIG. 4 is a perspective view of a portion of the machine.

As shown in more detail in FIG. 4, a preferred arrangement for the sets of vanes 82 and 84 comprises a pair of circular backplates 86 and 88 axially aligned, respectively, with the two divider plates 66 and 68. These backplates project radially outwardly from the shaft 80, with the lower backplate 86 having a diameter substantially larger than the diameter of the upper backplate 88. The two backplates 86 and 88 respectively support a plurality of upwardly extending fins 90 and 92 which project generally in a radial direction from the shaft 80 toward the outer diameter of the associated backplate 86 or 88. Conveniently, these fins are angularly set with respect to the radial direction to provide side faces 95 (FIG. 3) presented in the direction of impeller rotation, illustrated by arrow 97 and radially outwardly to centrifugally throw the product away from the rotor without trapping product pieces between the fins and the shaft. Moreover, these fins 90 and 92 include curved outer edges 94 to help avoid damage to the product poured into the machine.

In operation, the product 12 is poured through the hopper 16 and through the opening 61 in the cover plate 60 into the interior of the impeller 22. At the same time, the impeller 22 is rotatably driven by the driving shaft 56 to rotate the base plate 54, cover plate 60, divider plates 66 and 68, paddles 62, and rotor 76 within the knife housing 26. The falling product 12, by a combination of striking the rotating sets of vanes 82 and 84 and the base plate 54, is divided into a plurality of substantially uniform mass flows which are centrifugally thrown in a radially outward direction toward the knife housing 26. The paddles 62 carry the centrifugally thrown product pieces in the direction of impeller rotation whereby each of the product pieces alternately slide along the inner arcuate surfaces 52 of the arcuate sections 32 and into cutting engagement with the cutting knives 24. Conveniently, to assist in positive engagement between the product pieces and the cutting knives 24, the paddles 62 are each set at an angle with respect to the radial direction to define a side face 99 presented in the direction of impeller rotation and radially outwardly toward the cutting knives 24.

The relative sizes of the sets of vanes 82 and 84, together with the radial spacing between the vane sets and the divider plates 66 and 68 is chosen to achieve substantially uniform mass flow of the product into the three axial passages 70, 72, and 74. In this manner, substantially the full lengths of the cutting knives 24 are used to increase machine production rate capacity and to prolong operating cycles between knife replacement or sharpening and to substantially increase machine production rate. Moreover, this uniform distribution of the product has been found to result in a significantly reduced loading upon the drive motor for the impeller when surges of the product are supplied to the impeller, thereby preventing overloading of the drive motor and/or enabling use of a less expensive and lower power motor to achieve the increased production rate.

For example, as illustrated in FIGS. 2 and 3, the upper set of vanes 84 project from the rotor shaft 80 in the radially outward direction whereby the backplate 88 intercepts a portion of the falling product and cooperates with the fins 92 to throw that portion of the product into the upper passage 74 between the cover plate 60 and the upper divider plate 68. To assist in the interception of the falling product, the upper divider plate 68 has an inner diameter 96 which is slightly less than the inner diameter of the cover plate 60. Importantly, in the embodiment shown, the backplate 88 and the upper divider plate 68 are sized to intercept approximately one-third of the product and to allow axial passage of approximately two-thirds of the product downwardly therebetween toward the lower set of vanes 82 and toward the baseplate 54.

The lower set of vanes 82 including the backplate 86 intercepts another portion of the falling product and cooperates with the fins 90 to throw that portion of the product into the middle axial passage 72 between the two divider plates 66 and 68. This lower backplate 86 has a diameter larger than the diameter of the upper backplate 88 so that it projects into the path of the falling product. Conveniently, this backplate 86 cooperates with the lower divider plate 66 which has an inner diameter 100 substantially less than that of the upper divider plate 68 to intercept approximately one-half of the remaining falling product, or approximately one-third of the total product, for direction into the middle passage 72. The remaining one-third of the product falls axially between the lower set of vanes 82 and the lower divider plate 66 where it is centrifugally thrown into the lower passage 70 by the rotating base plate 54.

When the product 12 fed into the machine has widely variant dimensions, the axial dimensions of the passages 70, 72, and 74 can be chosen to achieve substantial orientation of the product with respect to the cutting knives 24 and thereby obtain significant improvements in the overall size distribution of the final cut product pieces 14. For example, when the product 12 comprises potato slabs or slices of relatively small thickness and relatively large length and/or width, it is highly desirable to orient the slices generally with their major plane oriented along the radial direction so that the slices are cut by the knives 24 along their length or width, and not along their thickness. Alternately stated, it is not desirable for the slices to be cut in a random orientation wherein a substantial portion of the slices are vertically oriented during cutting to provide a high proportion of extremely short pieces which, with potato products, tend to deter from the appearance of the final product and which result in the release of excessive quantities of free starch.

According to the invention, the axial dimensions of the passages 70, 72, and 74 are chosen to be approximately equal to or less than the average length or width of the product slices 12. Thus, a substantial number of the product slices must orient with their major plane corresponding generally with the major plane of the passages 70, 72, and 74 in order to enter those passages. The agitation and centrifugal direction imparted to the product slices 12 is sufficient to cause this substantial portion of the slices to become properly aligned without clogging of the passages, and alignment of this substantial portion of the slices is instrumental in causing corresponding alignment of an additional substantial portion of the slices having lengths and widths smaller than the axial dimension of the passages. In this manner, the substantial majority of the product slices engage the cutting knives 24 for cutting of thin strips 14 from the ends or sides of the oriented slices, but not for cutting through the thickness of the slices to result in substantial increase in overall size distribution of the strips 14. Moreover, where there is a significant difference between the length and width dimensions in a product slice 12 which engages the knives 24 end-first, it has been found that the product slice 12 frequently tends to turn itself upon the first cut to realign itself in the same plane for cutting longer strips with a side-first engagement.

The relative inner diameters of the cover plate 60 and the divider plates 66 and 68 are instrumental in allowing use of relatively narrow axial widths for the passages 70, 72, and 74 without clogging during operation. For example, when the upper divider plate 68 has an inner diameter less than that of the cover plate opening 61, the linear distance between the inner diameter edges of the cover plate 60 and the upper divider plate 68 tends to be substantially greater than the axial spacing between the two plates. Therefore, a vertically oriented product slice 12 striking the divider plate 66 normally does not have sufficient length or width to bridge and become trapped between the plates 60 and 68 even through the slice may have a dimension greater than the axial width of the passage 74. The slice 12 is thus realigned into the desired planar orientation by the rotating impeller 22 for centrifugal entry into the passage 74.

In the same manner, the lower divider plate 66 has an inner diameter sufficiently less than that of the upper divider plate 68 so that the linear distance between the inner diameter edges thereof is substantially greater than the axial dimension of the central passage 72. Vertically oriented slices 12 striking the lower divider plate 66, therefore, do not bridge the two plates but instead realign into the desired orientation for entry into the passage 72.

In one operating embodiment of the invention, the product comprised potato slices or slabs cut lengthwise from whole potatoes to have an average length of about 2.75 inches, an average width of about 1.50 inches, and an average thickness of about one-half inch. The diameter of the impeller was selected to be about fourteen inches, and eight circumferentially spaced knive blades 24 were provided each having an axial length of about 4.5 inches. The divider plates 66 and 68 were each about one-eighth inch thick and were axially spaced from each other to define the axially open passages 70, 72, and 74 each having an axial width of about one and one-eighth inch. The potato slices were fed into the machine at a mass flow rate of about 10,000 pounds per hour, and the impeller was rotated at about 500 r.p.m. to convert the slices into relatively thin strips or shreds 14 for use as hashbrown potatoes.

The potato slices were quickly and easily cut into high quality shreds without clogging of the axial passages and with a substantially uniform distribution of cutting along the axial length of each cutting knife. In addition, the shreds 14 were found to have a remarkably improved overall length distribution when compared with conventional rotary cutting machines of the type disclosed in U.S. Pat. No. 2,195,879 utilizing a conventional impeller without the distribution and alignment features of the impeller of this invention. Moreover, the flow rate of about 10,000 pounds per hour of the product slices comprised an approximately two-fold increase in maximum production rate when compared to such prior machines. The length distribution by shred count and by weight for a conventional machine and for the example herein is shown by Table I as follows:

TABLE I

| SHRED LENGTH (inches) | CONVENTIONAL IMPELLER WEIGHT % | CONVENTIONAL IMPELLER COUNT % | IMPROVED IMPELLER WITH DISTRIBUTION AND ALIGNMENT WEIGHT % | IMPROVED IMPELLER WITH DISTRIBUTION AND ALIGNMENT COUNT % |
|---|---|---|---|---|
| 0–0.5 | 52.3 | 77.6 | 10.4 | 39.8 |
| 0.5–1.0 | 30.6 | 16.5 | 28.2 | 30.6 |
| 1.0–1.5 | 13.8 | 5.0 | 21.9 | 15.5 |
| 1.5–2.0 | 3.3 | 0.9 | 22.3 | 8.9 |
| over 2.0 | 0 | 0 | 17.2 | 5.2 |
| | 100.0% | 100.0% | 100.0% | 100.0% |

The present invention thus provides substantial improvements in the production rate, operating cycle, and product quality in a rotary cutting machine particularly designed for cutting vegetable products such as potatoes. The invention is particularly suited for cutting thin potato slabs or slices into thin elongated shreds of high quality and remarkably improved overall length distribution.

Various modifications and improvements to the invention disclosed herein are believed to be apparent to one skilled in the art. For example, various numbers of divider plates and impeller vanes can be used according to the particular operating characteristics. Accordingly, no limitations upon the invention are intended, except by way of the appended claims.

What is claimed is:

1. A rotary cutting machine for cutting a product into a plurality of pieces, comprising:

a generally cylindrical housing having a plurality of circumferentially spaced, axially open slots formed therein;

a plurality of cutting knives each including an axially extending cutting edge at one side of a respective one of said slots, said cutting edges being presented in a common circumferential direction; and a generally cylindrical impeller mounted for rotation within said housing, said impeller including a base plate closing one axial end thereof, an annular cover plate at the opposite axial end defining a central opening for admission of a flow of the product into the impeller, means cooperating with said base plate and said cover plate to form a plurality of axially separated and radially open passages, said passages forming means including at least one annular divider plate disposed axially between said base and cover plates and generally in parallel therewith, and a plurality of circumferentially spaced axially extending paddles connected to said base, cover, and divider plates near their peripheries for securing said base, cover, and divider plates with respect to each other and for rotationally carrying the product flowing through said passages into cutting engagement with said cutting knives, and means for directing the flow of the product upon rotation of the impeller in a radially outward direction for flow in substantially equal portions through said passages into cutting engagement with said cutting knives.

2. The rotary cutting machine of claim 1 wherein said impeller is mounted for rotation about a substantially vertical axis generally common to said housing.

3. The rotary cutting machine of claim 1 wherein said divider plate has an inner diameter substantially less than the inner diameter of said cover plate.

4. The rotary cutting machine of claim 1 wherein said passage forming means comprises a pair of annular divider plates disposed axially between said base and cover plates and generally in parallel therewith, said divider plates being axially spaced from each other and from said base and cover plates to define three axially separated and radially open passages.

5. The rotary cutting machine of claim 4 wherein said divider plate adjacent said cover plate has an inner diameter substantially less than the inner diameter of said cover plate, and wherein said divider plate adjacent said base plate has an inner diameter substantially less than the inner diameter of the other divider plate.

6. The rotary cutting machine of claim 1 wherein said flow directing means comprises a rotor projecting from said base plate generally along the axis of said impeller and including a set of axially and radially extending vanes positioned generally in axial alignment with said divider plate and spaced radially inwardly therefrom.

7. The rotary cutting machine of claim 6 wherein said set of vanes comprises a generally radially extending circular backplate generally aligned axially with said divider plate, and a plurality of fins formed on said backplate to extend axially toward the direction of the flow of the product into the impeller and radially toward said divider plate.

8. The rotary cutting machine of claim 1 wherein the product comprises a plurality of relatively thin slices, and wherein each of said passages has an axial dimension sized to prevent entry of a substantial portion of said slices thereinto unless said slices are oriented generally in parallel with the radial plane of said passages.

9. The rotary cutting machine of claim 8 wherein said passage forming means comprises at least one annular divider plate having an inner diameter sufficiently less than the inner diameter of said cover plate such that the distance between the radially inner edge of the cover plate and the radially inner edge of the divider plate is greater than the length or width of a substantial portion of said slices.

10. The rotary cutting machine of claim 1 or 8 wherein the product comprises a potato.

11. The rotary cutting machine of claim 10 wherein said cutting edge of each of said cutting knives is shaped to divide the product into a plurality of elongated, relatively thin shreds.

12. The rotary cutting machine of claim 1 wherein said housing has a generally cylindrical inner diameter surface, and wherein the cutting edge of each of said cutting knives is radially inset slightly from said inner diameter surface.

13. A rotary cutting machine for cutting a product into a plurality of pieces, comprising:

a generally cylindrical housing having a plurality of circumferentially spaced, axially extending slots;

a plurality of cutting knives each including an axially extending cutting edge at one side of a respective one of said slots, said cutting edges being presented in a common circumferential direction; and a generally cylindrical impeller mounted for rotation within said housing and with respect to a substantially vertical axis generally common to said housing, said impeller including a cover plate at the upper axial end thereof and having a central flow opening therein for admission of a flow of the product downwardly into the interior of the impeller, a base plate closing the lower axial end of said impeller, means for securing said base plate and cover plate for rotation together, and means forming at least one radially open passage communicating between the interior of said impeller and said housing and for centrifugally throwing the product upon rotation of the impeller in a generally radially outward direction through said passage for cutting engagement with said cutting knives with generally uniform product distribution along the axial length of said cutting edges, said passage and throwing means comprising at least one annular divider plate disposed axially between said cover plate and said base plate and generally in parallel therewith, said divider plate cooperating with said base and cover plates to define at least two axially separated and radially open annular passages communicating between the interior of said impeller and said housing, and a rotor extending generally along the axis of said impeller in radially spaced relation with said divider plate, said rotor including a set of axially and radially extending vanes.

14. The rotary cutting machine of claim 13 wherein said means for securing said base plate and said cover plate with respect to each other comprises a plurality of axially extending, circumferentially spaced paddles connected to said base, cover, and divider plates, near their peripheries, said paddles being rotatable with said base, cover, and divider plates to carry the thrown product rotationally into cutting engagement with said cutting knives.

15. The rotary cutting machine of claim 13 wherein said divider plate has an inner diameter substantially less than the inner diameter of said cover plate.

16. The rotary cutting machine of claim 13 wherein said vanes are disposed generally in axial alignment with said divider plate.

17. The rotary cutting machine of claim 13 wherein the product comprises a plurality of relatively thin slices having a substantial length and width, and wherein each of said passages has an axial dimension for passage of a substantial portion of said slices only when oriented substantially in parallel with the radial plane of said passages.

18. The rotary cutting machine of claim 17 wherein said divider plate has an inner diameter sufficiently less than the inner diameter of said cover plate such that the distance between the radially inner edges of said divider plate and said cover plate is greater than the length or the width of at least a substantial portion of said slices.

19. The rotary cutting machine of claim 13 wherein said set of vanes comprises a generally radially extending circular backplate generally in axial alignment with said divider plate, and a plurality of fins projecting axially upwardly from said backplate.

20. The rotary cutting machine of claim 19 wherein said fins are angularly positioned on said backplate to provide a side face presented generally radially outwardly and in the direction of impeller rotation.

21. A rotary cutting machine for cutting product slices into a plurality of pieces, comprising:

a generally cylindrical housing having a plurality of circumferentially spaced, axially open slots formed therein;

a plurality of cutting knives each including an axially extending cutting edge at one side of a respective one of said slots, said cutting edges being presented in a common circumferential direction; and a generally cylindrical impeller mounted for rotation within said housing about an axis generally common to said housing, said impeller including means forming an inlet at one axial end thereof for admission of the product slices into the interior of the impeller, a plurality of axially separated and radially open annular passages communicating between the interior of the impeller and the housing, and a central rotor extending generally along said axis within said impeller and including a set of axially and radially extending vanes, said rotor being for centrifugally throwing the slices from the interior of the impeller in a generally radially outward direction through said passages into cutting engagement with said cutting knives, said passages each having an axial dimension for limiting the slices for entry thereinto when a substantial portion of the slices are oriented generally in a plane corresponding with the radial plane of said passages.

22. The rotary cutting machine of claim 21 wherein said vanes on said rotor are positioned for centrifugal throwing of the slices through said passages for generally uniform cutting engagement across the axial lengths of said cutting knives.

23. The rotary cutting machine of claim 21 wherein said passage forming means comprises a plurality of annular divider plates disposed generally in parallel with each other and each having an inner diameter inversely proportional to the distance thereof from said inlet.

24. The rotary cutting machine of claim 23 wherein the slices are relatively thin and have a substantial length and width, and wherein the inner diameters of each adjacent pair of said divider plates are sized such that the distance between their radially inner edges is greater than the length or width of a substantial portion of the slices.

25. A rotary cutting machine for cutting potato slices into a plurality of pieces, comprising:

a generally cylindrical housing having a plurality of circumferentially spaced, axially open slots formed therein;

a plurality of cutting knives each including an axially extending cutting edge at one side of a respective one of said slots, said cutting edges being presented in a common circumferential direction; and a generally cylindrical impeller mounted for rotation within said housing about an axis generally common to said housing, said impeller including a cover plate having a central opening therein forming an inlet at one axial end thereof for admission of the slices into the interior of the impeller, a base plate closing the other axial end thereof, means for securing said cover plate and base plate for rotation together, and at least one divider plate disposed axially between said base and cover plates and cooperating therewith to define a plurality of radially open and axially separated annular passages communicating between the interior of the impeller and said housing, each of said passages having an axial dimension for limiting a substantial portion of the slices to entry thereinto when the slices are oriented substantially in a plane corresponding to the radial direction, and a rotor projecting from said base plate generally along the axis of said impeller and including axially and radially extending vanes for centrifugally throwing the slices from the interior of the impeller through said passages into cutting engagement with said cutting knives with a substantially uniform axial distribution of the slices along the axial lengths of said cutting knives.

26. A rotary cutting machine for cutting product slices into a plurality of pieces, comprising:

a generally cylindrical housing having a plurality of circumferentially spaced, axially open slots formed therein;

a plurality of cutting knives each including an axially extending cutting edge at one side of a respective one of said slots, said cutting edges being presented in a common circumferential direction; and a generally cylindrical impeller mounted for rotation within said housing about an axis generally common to said housing, said impeller including a generally circular base plate closing one axial end thereof, an annular cover plate at the other axial end thereof and defining an inlet opening for admission of the slices into the interior of the impeller, at least one annular divider plate axially between said base and cover plates and cooperating therewith to define at least two radially open and axially separated passages for flow of the slices from the interior of the impeller into cutting engagement with said cutting knives, a plurality of axially extending and circumferentially spaced paddles connected to said base, cover, and divider plates near their peripheries and rotationally carrying the thrown product into cutting engagement with said cutting knives, and a rotor projecting from said base plate generally along said axis in spaced relation with said divider plate for centrifugally throwing the slices upon impeller rotation through said passages into cutting engagement with said cutting knives.

27. The rotary cutting machine of claim 26 wherein at least two of said divider plates are positioned axially between said base and cover plates and cooperate therewith to define at least three radially open passages.

28. The rotary cutting machine of claim 27 wherein the slices are relatively thin and have a substantial length and width, and wherein each of said divider plates has an inner diameter substantially less than the inner diameter of said cover plate and inversely proportional to the distance thereof from said inlet opening.

29. The rotary cutting machine of claim 28 wherein said rotor includes a plurality of sets of axially and radially extending vanes, each of said sets being generally in axial alignment with a respective one of said divider plates and having a diameter generally inversely proportional to the inner diameter of said associated divider plate.

30. A rotary cutting machine for cutting a product into a plurality of pieces, comprising:

a generally cylindrical housing having a plurality of circumferentially spaced, axially open slots formed therein;

a plurality of cutting knives each including an axially extending cutting edge at one side of a respective one of said slots, said cutting edges being presented in a common circumferential direction; and a generally cylindrical impeller mounted for rotation within said housing, said impeller including a base plate closing one axial end thereof, an annular cover plate at the opposite axial end defining a central opening for admission of a flow of the product into the impeller, means cooperating with said base plate and said cover plate to form a plurality of axially separated and radially open passages, and a rotor projecting from said base plate generally along the axis of said impeller and including axially and radially extending vanes for directing the flow of the product upon rotation of the impeller in a radially outward direction for flow in substantially equal portions through said passages into cutting engagement with said cutting knives.

* * * * *